United States Patent [19]

Sang

[11] 3,942,341

[45] Mar. 9, 1976

[54] ADDITIVE DISPENSING SYSTEM

[75] Inventor: Henry W. Sang, Louisville, Ky.

[73] Assignee: General Electric Company, Louisville, Ky.

[22] Filed: Aug. 30, 1974

[21] Appl. No.: 501,877

[52] U.S. Cl. ..... 68/17 R; 68/207

[51] Int. Cl.[2] ..... D06F 39/02

[58] Field of Search ..... 68/17 R, 207, 17 A; 134/93, 100, 101; 137/268

[56] References Cited

UNITED STATES PATENTS

| | | | |
|---|---|---|---|
| 3,760,612 | 9/1973 | Bochan et al. | 68/17 R |
| 3,822,571 | 7/1974 | Waugh | 68/17 R |

*Primary Examiner*—Houston S. Bell, Jr.

[57] ABSTRACT

An improved additive dispensing system for sequentially dispensing a plurality of treating agents into the wash tub of an automatic fabric washing machine at predetermined times during the washing cycle. A plurality of compartments are provided for retaining the various laundry additives to be dispensed into the wash tub. A channel is in liquid flow communication between one compartment and a liquid supply means arranged for directing liquid into the channel. An aperture is provided in the bottom of the channel for effectively removing contaminating lint from the liquid prior to introduction of the liquid into the compartment.

6 Claims, 3 Drawing Figures

ADDITIVE DISPENSING SYSTEM

BACKGROUND OF THE INVENTION

1. Field of the Invention:

This invention relates to laundry machines, and more particularly to a mechanism in the laundry machine to improve the dispensing of laundry additives.

2. Description of the Prior Art:

Recent automatic clothes washing machines customarily proceed through a sequence of operation in order to wash, rinse and spin dry clothes. The sequence ordinarily includes a presoak, a first liquid extraction operation, a wash operation, a second liquid extraction operation, a rinse operation, and a final extraction operation.

In order to obtain the most desirable results from these machines, it has been found advantageous to introduce certain additives into the water or liquid used for a particular operation. A pre-wash additive is normally used in the soak operation, a soap or detergent is normally used in the washing operation and a bleach is often also used in this operation, while rinse agents are added to the rinse water.

In an automatic washing machine, it is desirable that these additives be dispensed automatically. When the dispensing of additives is automatic, the user may load the fabrics to be washed into the wash tub and place the additives into their proper compartments or containers, and the machine automatically completes the cycle of operations. Also, the best results are obtained if these various additives are dispensed with liquid so that additives are metered into the wash tub and evenly distributed rather than being concentrated into a few of the articles.

One such dispensing system for an automatic washing machine is disclosed in U.S. Pat. No. 3,727,434 assigned to the same assignee as the present invention. As disclosed in that patent the dispenser is normally latched to the access cover of the laundry machine for movement with the cover to an open position for access to the wash tub for loading fabrics therein, and unlatched for movement independent of the cover to a position over the tub for introducing treating agents into the dispenser.

The dispenser includes a plurality of compartments for storing treating agents to be dispensed selectively during the prewash, wash and rinse operations and a plurality of liquid inlets arranged to communicate with the compartments. In its operative effective position over the tub the liquid inlets are in a position to cooperate with the outlets of a liquid supply device. The liquid supply device is sequentially controlled to selectively direct recirculation liquid into preselected ones of the liquid inlet for mixing liquid with the treating agents being held in the compartments to flush the agents into the wash tub at predetermined times in a cycle of the automatic washing machine.

In such a dispenser as described above the dilution and flushing of bleach is particularly troublesome because of its propensity to discolor clothes if the bleach has not been properly diluted sufficiently prior to introduction into the tub containing the clothes. To accomplish proper dilution of the bleach the compartment for dispensing the bleach is provided with a siphon tube which has one leg longer than the other with the longer leg extending down outside the bleach compartment while the shorter leg is terminated a distance above the bottom of the bleach compartment so that the bleach solution cannot be dispensed from the compartment until water entering the compartment has been raised to above the siphon opening thereby assuring dilution of the bleach before dispensing into the tub. One of the difficulties with this arrangement however is that the dispensing system utilizes recirculation water from the tub as the means for flushing the agents into the wash tub. Recirculation water, that which has been used previously in the soak operation contains lint or other relatively large contaminants which when introduced into the bleach compartment can clog the siphon and render its operation unusable.

By my invention I have improved the additive dispensing system in that I have provided a means for removing most of the contaminating lint and other large particles from the recirculation water just prior to introduction into the bleach compartment.

SUMMARY OF THE INVENTION

There is provided a treating agent dispenser system for washing machine of the top loading type including a dispenser adapted to be mounted above the machine's wash tub. This dispenser has a plurality of compartments for holding treating agents to be dispensed into the wash tub and a channel having a bottom and side walls in liquid flow communication between one compartment and a liquid supply means arranged for directing liquid into the channel.

This invention relates to providing a means for removing lint and other large contaminants from the liquid prior to introduction into the compartment consisting of providing an aperture in the bottom wall of the channel upstream of the compartment and spaced from the channel side walls with the portion of the aperture adjacent each side wall being divergent in a direction away from the side wall.

DESCRIPTION OF THE PREFERRED EMBODIMENT

Figure 1:
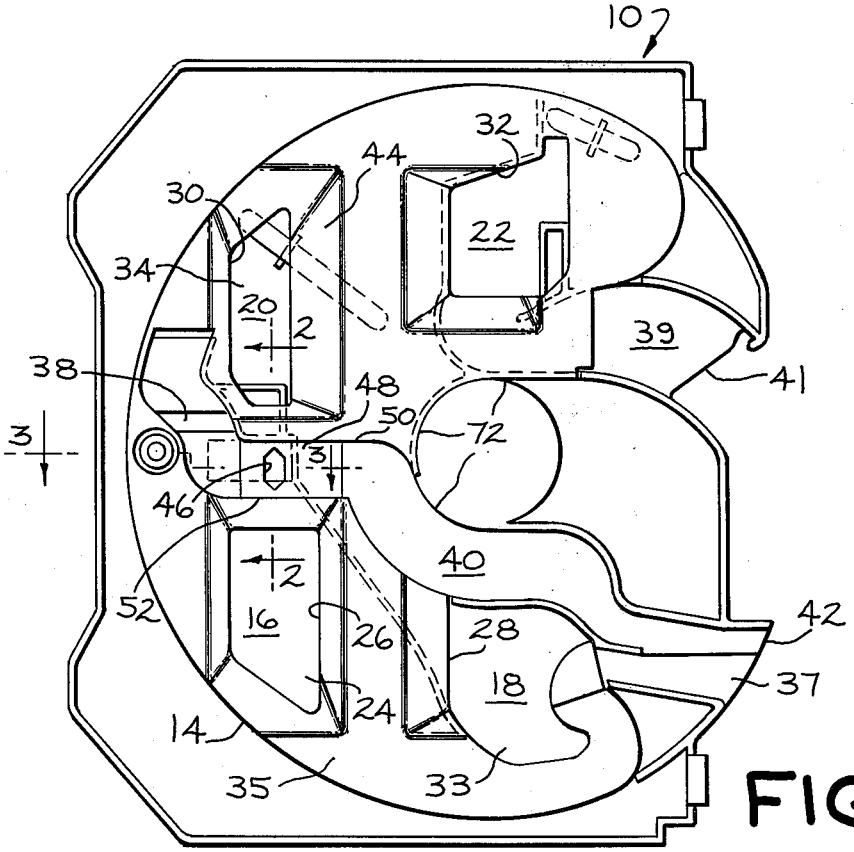
FIG. 1 is a plan view of the dispensing system showing the present improvement invention with parts broken away.

Referring to FIG. 1, the dispenser 10 for an automatic clothes washer is shown with the cover (not shown) removed therefrom to expose the details of construction of the present embodiment. The dispenser 10, as shown, is generally an annularly-shaped segmented channel or trough defined by annular inner and outer walls 12 and 14 respectively. The dispenser 10 is divided into four annular compartments 16, 18, 20, and 22. The presoak agent is placed in compartment 18 through opening 28, detergent is placed in compartment 16 through opening 26, bleach is placed into compartment 20 through opening 30, and rinse agent is placed in compartment 22 through opening 32.

Unlike compartments 16, 20 and 22, compartment 18 is not designed to store a treating agent but merely provides a passageway for introducing prewash liquid treating agents directly into the washing machine tub or into a filter pan located between the tub and dispenser 10 to be effective during the first fill cycle of the machine. To this end the bottom wall portion of the compartment 18 has a large opening 33 to facilitate easy dispensing of the prewash agent.

Liquid being pumped from the wash tub is introducted into the dispenser 10 by a liquid flow diverter mechanism (not shown). The liquid for compartment 16 flows through channel 35 from inlet 35 to the compartment. Liquid for compartment 22 flows through channel 39 from inlet 41 to the compartment. Liquid for compartment 20 flows through channel 40 from inlet 42 to the compartment.

The liquid flow diverter mechanism is sequentially controlled to selectively direct recirculation liquid into preselected inlets 37, 41 and 42 for mixing liquid with the treating agents being held in the compartments to flush the agents into the wash tub at predetermined times in a cycle of the automatic washing machine.

Detergent or soap to be dispensed from compartment 16 during the wash cycle is usually in solid, granular or high viscosity water soluble form. The bottom of the compartment 16 is provided with a discharge outlet at one end thereof (not shown) for flushing the detergent or soap to be dispensed into the wash load.

Bleach stored in compartment 20 is dispensed during the wash cycle subsequent to the dispensing of the detergent in a manner that will hereinafter be described in detail. Compartment 20 is defined by a bottom wall 34 and side walls, one side wall 36 being shown in FIG. 2. Extending into compartment 20 is an outlet end 38 of a passageway or channel 40. Channel 40 is located adjacent the cover and connects the compartment 20 with the liquid inlet area 42. At the proper time in the washing operation usually after the detergent is flushed, the machine timer controls introduction of recirculation water into liquid inlet area 42 for flow through channel 40 and into the bleach compartment 20.

Provision is made to drain the compartment 20 when there has been a sufficient amount of recirculation water introduced into the compartment to dilute the concentrated bleach prior to introduction of a diluted bleach solution into the wash load. One embodiment is shown in connection with the present invention and consists of a siphon tube 44. The siphon operates in a normal fashion wherein it has a short leg positioned within the chamber 20 and spaced above the bottom wall 34 thereof. The other leg of the siphon extends through the bottom of the wall 34 and in communication with the interior of the wash tub for dispensing the diluted bleach solution into the wash.

When the diluted bleach solution reaches the top of the siphon the siphoning action starts with the diluted bleach solution being drained slowly through the siphon and into the wash load. It will be understood that this action of draining through the siphon will continue until the water entering the compartment 20 through outlet 38 terminates and then the mixture of bleach and water in the compartment will continue to flow out through the siphon until the compartment 20 is emptied.

Figure 2:
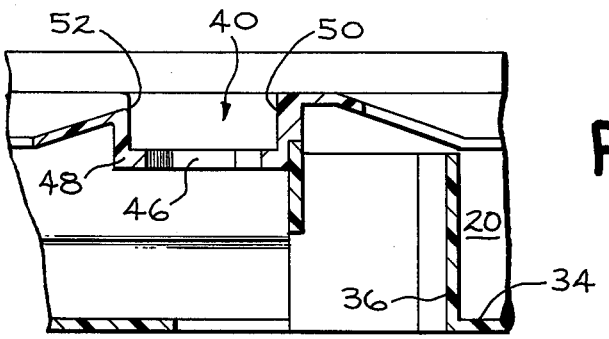
FIG. 2 is a fragmentary enlarged sectional view taken along lines 2—2 of FIG. 1.
Figure 3:
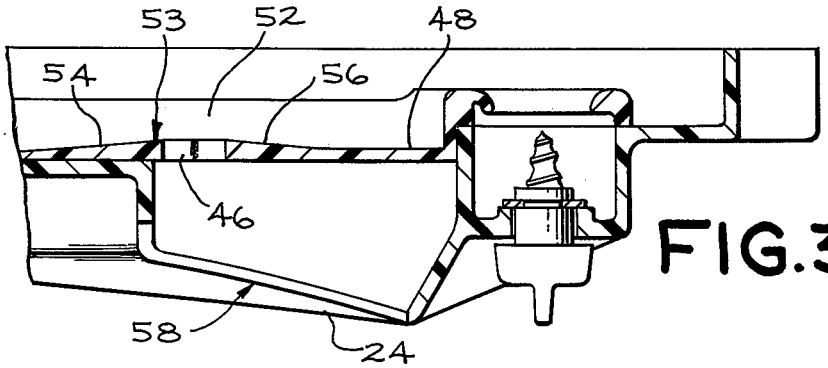
FIG. 3 is a fragmentary enlarged sectional view taken along lines 3—3 of FIG. 1.

One of the difficulties with this bleach dilution and flushing arrangement is that the hole or tube diameter through which the dilute bleach solution is dispensed is necessarily quite small due to the desire to add the bleach solution to the wash slowly. It has been found that by using recirculation water that contains lint and other large contaminants there is a possibility that the hole or tube will become clogged and detrimentally affect the flushing or evacuating operation. Referring to FIGS. 1-3 there is shown means for separating lint and other large contaminants from the recirculation water prior to introduction of the recirculation water into compartment 20. There is provided an aperture 46 upstream of the compartment 20 and located in the bottom wall 48 of channel 40. The aperture 46 is in communication with the interior of the washer through an opening 58 in the bottom of the dispenser and into an underlying filter pan if there is one. The aperture 46 extends across a major portion of the channel bottom wall 48 and is spaced from upstanding channel side walls 50 and 52 with the portion of the aperture adjacent each of the respective side walls being divergent in a direction away from the side wall. The spacing of the aperture from the channel side walls can be varied depending upon the desired liquid flow rate for entering into the compartment. The greater the space the higher the flow rate into the compartment 20. The aperture may be of various dimensions with the portion of the aperture adjacent each of the channel side walls being divergent in a direction away from the side wall. In the drawings such an aperture has triangular end portions, however, they may also be curved inwardly. In the preferred embodiment the aperture 46 is located in a ramp portion 53 consisting of ascending and descending ramps 54 and 56, respectively, which ramp portion forms a part of the channel bottom wall 48. It will be noted that the aperture is located between the ascending and descending ramps. This ramp arrangement tends to increase the liquid flow velocity in the ramp portion 53 and enhances the lint removal from the liquid passing along the channel 40. By this arrangement the recirculation water traveling through the channel 40 carrying with it lint and other contaminant particles encounters the aperture 46 which disrupts the liquid flow pattern such that some of the liquid with a large portion of the lint and other contaminants carried by the recirculation water passes down through aperture 46 while at the same time the other portion of the liquid which is relatively lint free passes between the divergent end portions of the aperture and the channel side walls and then into the bleach compartment 20 via channel outlet end 38. By this relatively simple arrangement the lint may be easily and effectively removed from the recirculation water and is deposited either into the wash tub or underlying filter pan, if there is one, and does not necessitate periodic cleaning which would normally be the case should the lint be removed by a screen.

The foregoing is a description of the preferred embodiment of the invention and variations may be made thereto without departing from the true spirit of the invention, as defined in the appended claims.

What is claimed is:

1. In a treating agent dispenser system for a washing machine of the top loading type including a dispenser adapted to be mounted above the machine's wash tub, said dispenser having a plurality of compartments for holding treating agents to be dispensed into the wash tub, a channel having a bottom and side walls in liquid flow communication between one compartment and a liquid supply means arranged for directing liquid into the channel, the improvement comprising a contaminate separating means including an aperture in the bottom wall of the channel upstream of the compartment, said aperture being spaced from the channel side walls and that portion of the aperture adjacent each side wall being divergent in a direction away from the side walls inwardly, whereby contaminates may pass through the aperture prior to introduction into the compartment.

2. In the treating agent dispenser system of claim 1 wherein the aperture extends across a major portion of the bottom wall of the channel.

3. In the treating agent dispenser system of claim 1 wherein the bottom wall of the channel has an ascending ramp portion and a descending ramp portion with the aperture being located between the two ramp portions.

4. In the treating agent dispenser system of claim 1 wherein the aperture is in fluid flow communication with the wash tub.

5. In the treating agent dispenser system of claim 1 wherein the one compartment is adapted to hold bleach as the treating agent.

6. In the treating agent dispenser system of claim 5 wherein a siphon is utilized to evacuate the compartment after the bleach is diluted by the liquid from the liquid supply means.

* * * * *